United States Patent [19]

Bourdier et al.

[11] Patent Number: 4,605,294

[45] Date of Patent: Aug. 12, 1986

[54] COMPOSITE OPTICAL DISPLAY METHOD AND RELATED APPARATUS

[76] Inventors: Jean-Claude Bourdier; Frederic G. Bourdier; Brigitte E. Bourdier; Claude H. Bourdier, all of 17, Place des Vosges, 75004 Paris, France

[21] Appl. No.: 646,352

[22] Filed: Aug. 31, 1984

[30] Foreign Application Priority Data

Jan. 30, 1984 [FR] France ..... 84 01417

[51] Int. Cl.[4] ..... G03B 21/26; G03B 21/22

[52] U.S. Cl. ..... 353/28; 353/77; 353/76

[58] Field of Search ..... 353/28, 30, 36, 37, 353/74, 78, 76, 77, 79, 121, 122; 434/94, 371

[56] References Cited

U.S. PATENT DOCUMENTS

| | | | |
|---|---|---|---|
| 2,061,378 | 11/1936 | Henze et al. | 353/28 |
| 3,507,570 | 4/1970 | Bourdier et al. | 353/28 |
| 3,864,032 | 2/1975 | Yanagawa | 353/76 |

FOREIGN PATENT DOCUMENTS

| | | | |
|---|---|---|---|
| 928215 | 5/1947 | France | 353/77 |

*Primary Examiner*—Harry N. Haroian

*Attorney, Agent, or Firm*—Charles E. Baxley

[57] ABSTRACT

The installation permits the adjustment in succession on a screen E of the size of a series of typical images which are to be made to merge with the image of a person P so as to enable this person to view through a mirror M composite images thus obtained. The projector and its mirror M 2 are slidably mounted on a funicular railway whose rails 16 and 17 have a slope equal to the slope of the lowest ray of the projected beam.

15 Claims, 11 Drawing Figures

COMPOSITE OPTICAL DISPLAY METHOD AND RELATED APPARATUS

Method for dimensionally adjusting images in series for combining with natural personal images, in particular behind a mirror, for reviewing collections of adornments such as clothes, jewelry etc., and an installation and collections of images for carrying out said method, and composite images thus obtained.

The present invention relates to composite images which it is well known to achieve, in particular in cells or cabins having an unsilvered mirror, i.e. a semi-transparent mirror, by combination between:

on one hand, the personal virtual image that any person who places himself or herself in front of a mirror can see, and on the other hand, the real images of adornments (in particular clothes) which may be constituted in the plane of this virtual image, for example on a projection screen.

Installations for self-viewing such images have already been disclosed in Frence Pat. No. 1,544,746 of Sept. 18, 1967 and in the French Certificate of Addition No. 93,296 of Nov. 16, 1967. Such installations are particularily desirable in the fields of clothes, spectacle frames, jewelry, make-up, since they theoretically permit a plurality of clients to review very conveniently on themselves large collections the size and the handling of which are then reduced to those of simple collections of projector slides.

The practical problem which is nonetheless posed for this type of installation resides mainly in;

on one hand, the difficulty of suitably "fitting" the natural image with the successive images of the adornments, both owing to the wide range of heights and corpulences of the various persons likely to view themselves in succession, and owing to the difficulty of achieving a precise positioning of the projected images if only because of the constraints inherent in taking the photographs (these being taken under uncertain conditions on models who do not possess coinciding references to enable them to position themselves precisely in the field of the photograph at the place required by the subsequent projections;

on the other hand and consequently, the necessity to assign to these installations a projection operator who is capable, with the aid of suitable equipment, of correcting the anomalies of this type and adjusting each projected image in accordance with on one hand, his own errors or deviations resulting from the taking of the photograph, and on the other hand, the height and the corpulence of the various persons who see themselves in the installation.

These installations are therefore at the present time welcomed as concernes their principle of operation by professionals who sell collections of all types, but they remain marginal since the clients, i.e. the persons who view themselves in the installation, do not manage to identify themselves with the images with enthusiasm as soon as, even if these defects can be rapidly corrected by a skilled operator, the composite images are at least at the beginning in two parts which are badly connected, offset or out of proportion relative to each other as concerns height and corpulence. These defects are moreover rendered more serious by the fact that the virtual image that any viewer sees of himself or herself in the mirror is tridimensional, i.e. in relief, while the image projected on the screen is flat. In order to ensure that this inevitable difference is not too noticeable, it is consequently essential to avoid any other difference between the personal image and the projected image so that the attention of the person viewing himself or herself is immediately drawn to the strange sensation of "discovering" himself or herself carrying an adornment within a fraction of a second, as if by magic. As soon as there is an offset between the personal and projected images, the "magical" aspect of the illusion vanishes and the installation showing the collection is seen in an unfavorable light owing to its artificial character sometimes revealed in aspects which may be cruelly frustrating.

Therefore, an object of the present invention is to provide a method and means for achieving a perfect fitting together or junction between these two type of images not only as concerns the height and the corpulence, but also by means of a small and very simple procedure of "pre-setting" which permits effecting possible adjustments required before any projection of any image of an adornment (all the adjustments being carried out "blank", i.e. in the absence of any projection of the adornment, so that, right from the first projection, the first adornment "fits" perfectly to the measurements of the person viewing himself or herself), and in such manner that all the adornments which follow the first one continue to be "just right" without the risks due to the accidents of centering or proportions when taking the photograph.

The gist of the invention resides in the fact that although the image projected onto the screen, i.e. the image of the adornment, may be "made to measure" for the person viewing himself or herself by means of various conventional artifices (reflection of the beam projected onto an adjustable deforming mirror; rearward or forward movement or inclination of the projection relative to the screen, etc.), this "making to measure" must be carried out under precise conditions, i.e. in a controlled way without parasitic deformations and with an appropriate fitting together of the two images to be combined, and, by means of an operation which is completely independent of the actual projections of adornments, so as to ensure that the "marvelous" effect produced by these projections is not betrayed, and consequently completely spoiled by the direct perception on the adornments themselves of the absence of "true reality".

According to the invention, the precision of the control is achieved by a simple procedure;

there is chosen conventionally as a reference dimension a body dimension which is easy to identify on the personal image reflected by the mirror, for example the height of the shoulders from the ground, it is arranged that, in all the images to be projected in series, this dimension always has the same value for a given state of the projection installation, and, in order to ensure that the image projected of one of the elements of this dimension, for example that of the ground (i.e. that of the feet) is located at a predetermined place of the screen for all the projected images and regardless of the adjustments of the projection installation in such manner that the projected image may be, by means of these adjustments, enlarged or reduced in the region of the shoulders without moving the feet, there is projected as a "check sample" a first image in which is shown in the form of a sight mark the reference dimension (i.e. the height of the shoulder) which has a common value for the series of images of adornments to be projected and by an adjustment of the projected beam, this height is adjusted on the screen so that it tallies with the personal image, for example with the "hollow" of the neck of the person who is viewing himself or herself.

It is then certain that all of the adornment images which will be subsequently projected will perfectly tally with this same "hollow" of the neck.

The same control and the same precision can be employed as concerns corpulence if one bases oneself on the vertical axis of symmetry of the body viewed from the front and if the images of the adornments photographed on models having a normal corpulence are expanded more or less on each side of this axis.

These vertical and/or horizontal expansions are achieved by relatively conventional techniques but must nonetheless be suitably chosen and, as the case may be, adapted to the present particular application, in particular in order to avoid certain optical aberrations which would be incompatible with the obtainment of the desired result, namely the illusion, which is as perfect as posiible, that the image of the adornment is "truly" the image of something which is indeed carried by the person and seen as such by this person. Further, if the personal image is constituted by the face of the various persons who are viewing themselves in succession, the lighting of these faces should be adjusted in accordance with their height. It is consequently of interest to couple this adjustment in height of the lighting with that of the height of the projected images. In this way, the faces are suitably illuminated regardless of the height of the projections, i.e. regardless of the height of the person on the face of which these projections must connect up.

The invention also provides photographing means which practically avoid any adjustment in the centering and/or in the projection of the slides, and which makes it certain that the "reference dimension" has the same value on each of the slides and that the "reference base" is always at the same place on each of the slides.

This method and this photographing means in fact provide slides which are truly "calibrated" relative to the ground and the shoulder so that, if these elements are superimposed in a stack, these elements will be exactly face to face in this stack. In this way, as soon as the projection installation is suitably adjusted to the measurements of a person, the images of the slides may be shown one after the other and one can be sure that all the adornment images will tally with and marry up with the personal image of this person in a perfect manner for all these images.

The method for taking a photograph comprises, by a setting which is the opposite of that characterizing the installation at the disposal of the persons observing themselves, causing the model carrying the adornment to pose in front of a semi-transparent mirror behind which is disposed, in the plane of his or her image, a shoulder sight mark which is adjustable in height and with respect to which the model can locate his or her own shoulder, after adjustment for height, so as to ensure that all the photographs will have the shoulders calibrated to the same height. Correspondingly, the semi-transparent mirror is limited to the upper part of the body of the model since it is used only for placing the shoulders in position and the camera is disposed below and behind this mirror. In this way, the photographer who, from above his camera, sees the model through the rear side of the mirror at the same time sees the image in this same semi-transparent mirror viewed from the rear, of the shoulder sight mark placed behind and above the model. It is then very easy for him to take the photograph at the moment when the attitude of the model seems to him to tally suitably with the image of the shoulder sight mark. For the purpose of achieving the overall centering of the image, it is sufficient that the photographer place himself at such distance from the model that the lower edge of the photograph corresponds to the tip of the feet of the model and the upper edge is flush with the base of the nose for example. When these conditions are satisfied, it is absolutely certain that all the slides will be perfectly homogeneous with each other. In this way, the projections may be controlled under perfect conditions.

Further features of the invention will be apparent, and the invention will be better understood, from the following description of one manner of carrying out the invention which is given merely by way of a non-limiting example, with reference to the drawings in which.

Figure 1:
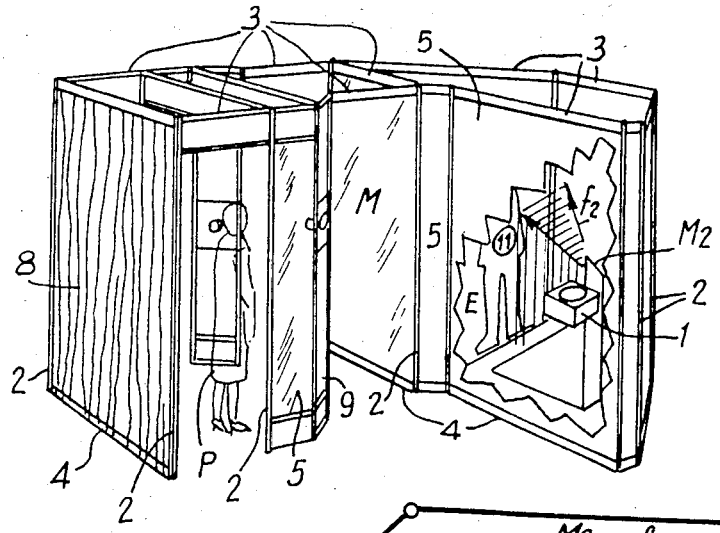
FIG. 1 is a perspective view of an installation for reviewing a collection of clothes with the illusion of seeing these clothes on the viewing person.
Figure 2:
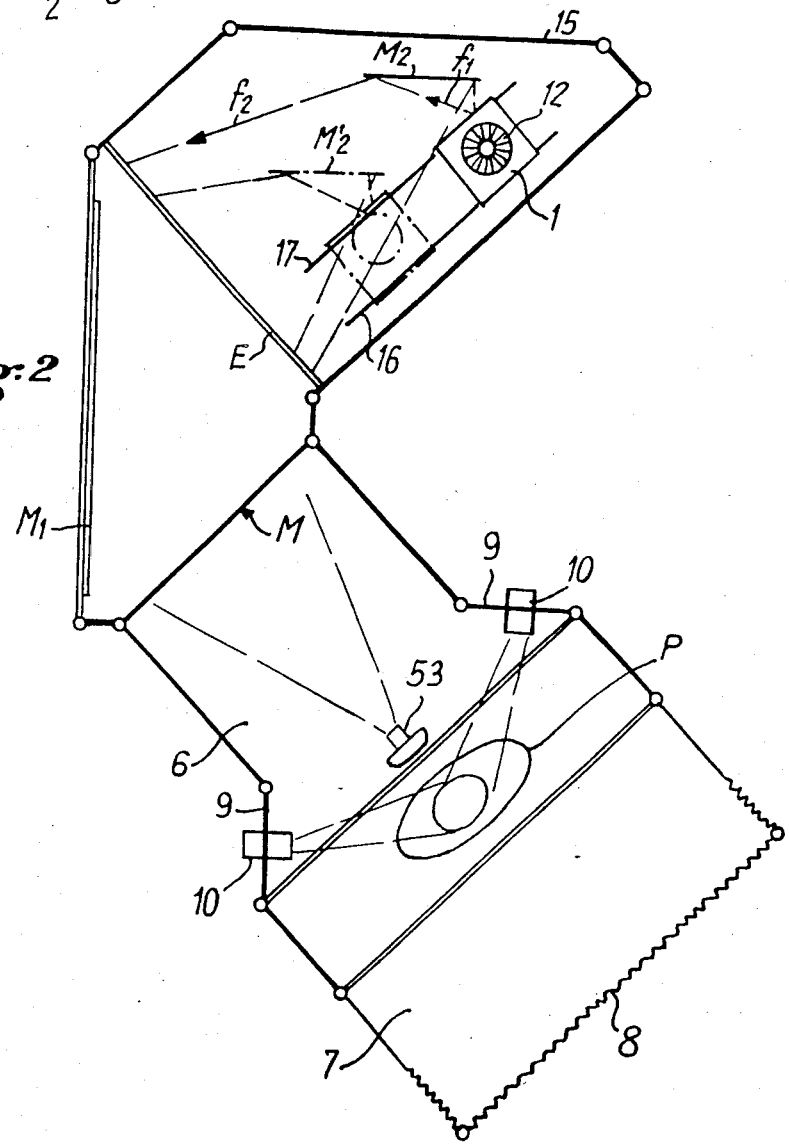
FIG. 2 is a general plan view of this installation.

With reference to FIGS. 1 and 2, there can be easily recognised a cell or cabin of the type disclosed in the French Pat. No. 1,544,746 and in its addition No. 93,296, namely a cell which enables a person P to view through a semi-transparent mirror M:

on one hand, his or her own image located at an equal distance behind this mirror, and, on the other hand, the image, in a second mirror M 1 inclined at 45° to the optical axis of a transluscent screen E on which slides are projected by a projector 1.

There will therefore be no need to describe here the basic equipment nor the conditions under which is achieved the "optical marrying up" by the joining, in the region of the neck, of the personal image of the person P (face) with successive images of adornments on a model which are projected (without the head) onto the screen E from slides.

It will merely be mentioned that, in order to render the cell more compact and to be able to place it in a corner of a room, the optical axis of the installation is broken at 90° by the mirror M1 and decomposed into two orthogonal semi-axes, one being on the viewer's side and the other on the projector side.

For the same reason, the light beam, f1,f2 projected onto the screen E is reflected by a trapezoidal mirror at 45° M 2 which will be referred to hereinafter.

The whole of the installation is housed in a conventional structure comprising pillars and upper cross-members 3 and lower cross-members 4 between which panels 5 are mounted.

The cell on the viewer's side consists of a roughly square room 6 which is reserved in front of the mirror and a slightly larger room 7 which is open at the rear and may be closed by a curtain 8.

The lateral walls of the two rooms are interconnected by inclined walls 9 in which are mounted projectors 10 for illuminating the face of the person P and which may be raised togegher to a varying extent in these inclined walls along cables (not shown) by a control system referred to hereinafter.

The light beams of these two projectors are slightly upwardly inclined so as to illuminate the faces slightly from below and to ensure that these beams do not "catch" the shoulders of the person illuminated in the dark room 7 and also to ensure that only the face of this person is illuminated in the image visible behind the mirror M.

Figure 3:
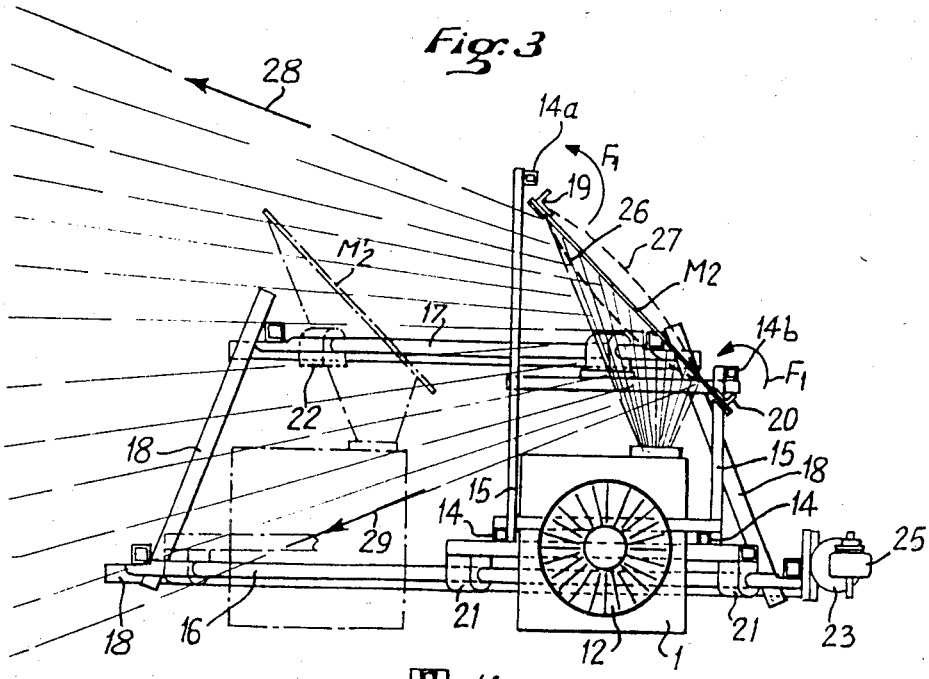
FIG. 3 is a similar plan view, to an enlarged scale, of the unit for projecting images of clothes.
Figure 4:
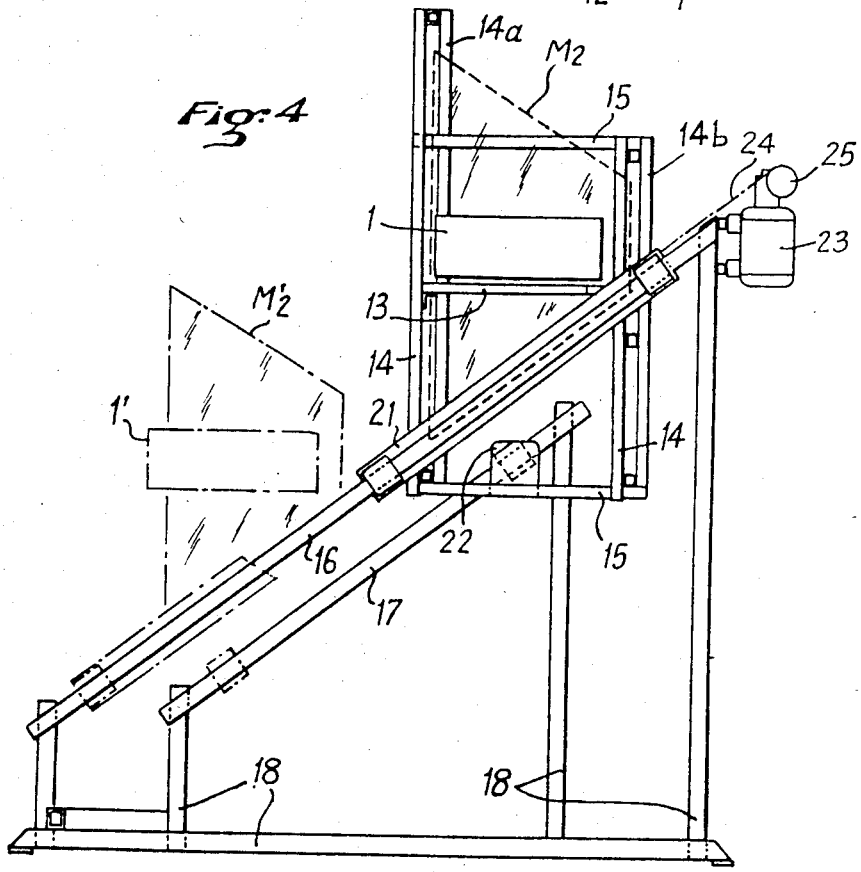
FIG. 4 is a corresponding elevational view of this unit.

There will now be described, with reference to FIGS. 3 and 4, the projection equipment by means of which it is possible to enlarge or reduce the image 11 (FIG. 1) projected onto the screen E from the slides.

The projector 1 and its magazine 12 are mounted on a platform 13 located at mid-height of an assembly constructed in the form of a cage having tubular uprights 14 and cross-members 15 which is slidable along two parallel rails 16 and 17 mounted on a frame 18. The rail 17 is slightly lower and set back relative to the rail 16 so as to define the space required for the travel of the trapezoidal mirror M 2 whose shape corresponds to the section at 45° of the beam f 1 having a rectangular section issuing from the projector 1. This mirror is held between two frames 19 and 20 (FIG. 3). The frame 19 is fixed to the upright 14a and the frame 20 is fixed to the upright **14*b*. Both are pivotable in the direction of the arrows F 1** by the action of a control to which reference will be made hereinafter.

The assembly supporting the projector 1 is guided on the rails 16 and 17 by small carriages 21 and 22. A motor 23 driving a cable 24 through a pulley 25 enables the assembly to be raised or lowered along the rails 16 and 17. Consequently, the projector 1 and its mirror M 2 can be brought to the lower position M'2 (FIGS. 4 and 5) merely by actuating the motor 23.

It will therefore be understood that the trapezoidal mirror M 2 sends a rectangular beam to the screen E and that if the assembly is moved along the rails 16 and 17 it is very easy to reduce in height and width the rectangle projected onto the screen, without modifying the horizontal lower base of this rectangle.

It is sufficient to arrange that the slope of the rails 16 and 17 be equal to the slope of the lowest ray of the beam projected onto the screen.

It will therefore be understood that, with such a device, if the images projected are formed by those of a model carrying an adornment down to the feet;

the feet do not move, the height is reduced or increased in a proportional manner, i.e. the height of the shoulder rises or descends if the projector is moved along the rails 16 and 17 of its funicular railway.

It will be observed that the incorporation of the mirror in the projector assembly enables the projected beam to be broken at 90° and therefore renders the cell shown in FIG. 1 more compact on the projector side without the image moving laterally on the screen E as would otherwise be the case if the mirror M 2 was larger and fixed to the partition wall 15 of the cell.

It will also be observed that it is relatively easy, with this type of structure, to vary the projected image from the point of view of "corpulence" for any value of shoulder height taken as a "reference dimension" in this image. Indeed, it is sufficient to make the mirror M 2 (at 26 and 27 in FIG. 3) "bulge" or "hollow" in the manner of deforming mirrors. This is why it has been arranged that the frames 19 and 20 be respectively pivotable about their vertical axis. However, if the mirror M 2 were rectangular and if the deformation were symmetrical as shown at 26 and 27, the expansion would be much too pronounced on the screen for the rays 29 than for the rays 28, i.e. more pronounced on the right than on the left (owing to the different distances between the pivoting sources of these rays and the screen).

Consequently, in order to correct this aberration which is incompatible with the necessity to produce a perfect illusion for the viewing person, the curvature of the mirror M 2 is produced with a torsion bar incorporated in the frame 20 (not shown). As a result of this, this curvature is very pronounced in the vicinity of this frame while, owing to the very reason of the greater stiffness of the mirror in the vicinity of the frame 19, it is less pronounced in the vicinity of this frame.

Under these conditions, when the slides projected onto the screen E are of the type already disclosed in French Pat. No. 1,544,746 representing clothes carried by a model whose head is hidden (either when taking the photograph or when projecting), it is realized that it is possible to make the images projected absolutely perfectly tally with the image of the face of any person, with adjustment of the "width" of the images to the particular corpulence of this person.

If, in addition, the actuation of the motor 23 which adjusts the shoulder height of the projected images is coupled to that of a motor winding or unwinding a cable from which the projectors 10 are suspended, it is clear that it is possible to increase or decrease the height of the lighting for the face of the person P at the same time as the height of the shoulders of the projected images is increased or decreased. It will be understood that, on one hand, a position in height of the projectors 10 corresponding to the position in height of the projector 1 on its funicular railway should be calibrated and, on the other hand, the relative displacements of these respectively movable elements should be coordinated.

Figure 5:
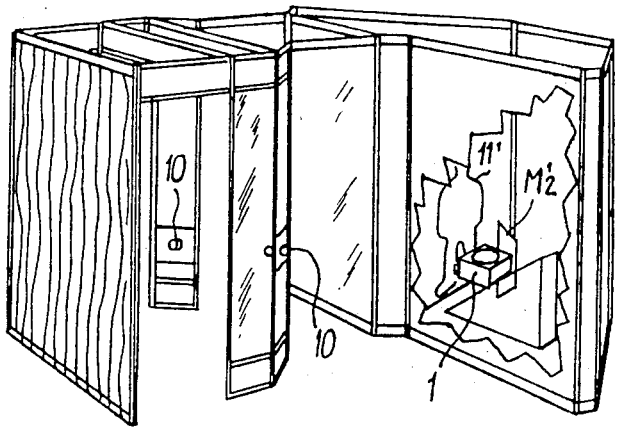
FIG. 5 is a view similar to FIG. 1 in which the installation is adjusted for self-viewing on the part of a small person.

The second adjustment concerns a coupling easy to achieve between the respective end positions of these elements, as is shown in FIG. 5 in which the projector is in the lower position with its mirror in the position M'2, while the projectors 10 themselves placed at the height corresponding to the face of a (small) person whose image must tally with the image 11' (small image) projected onto the screen E.

On the other hand, the first adjustment must be carried out with a projection of a slide representing a "standard" model and it will be understood in this respect that when this adjustment has been made, it is essential to arrange that all the slides are "aligned", i.e. "calibrated" to this standard model so that the adjustment thus carried out can be normally subsequently used with all the slides.

Therefore it will be understood that the photographs must be taken with a certain exactness.

Figure 6:
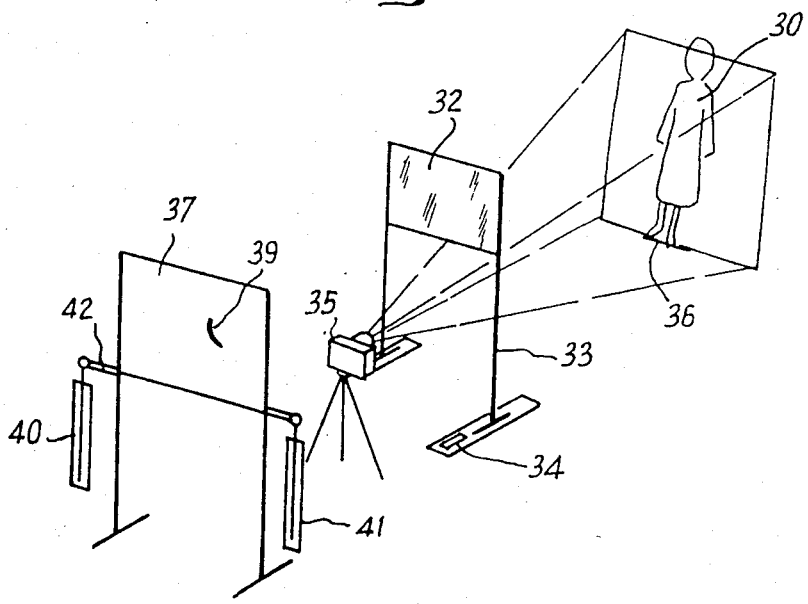
FIG. 6 is a perspective view of a scene of the photographing of a clothing of the collection in the mirror of the installation.
Figure 7:
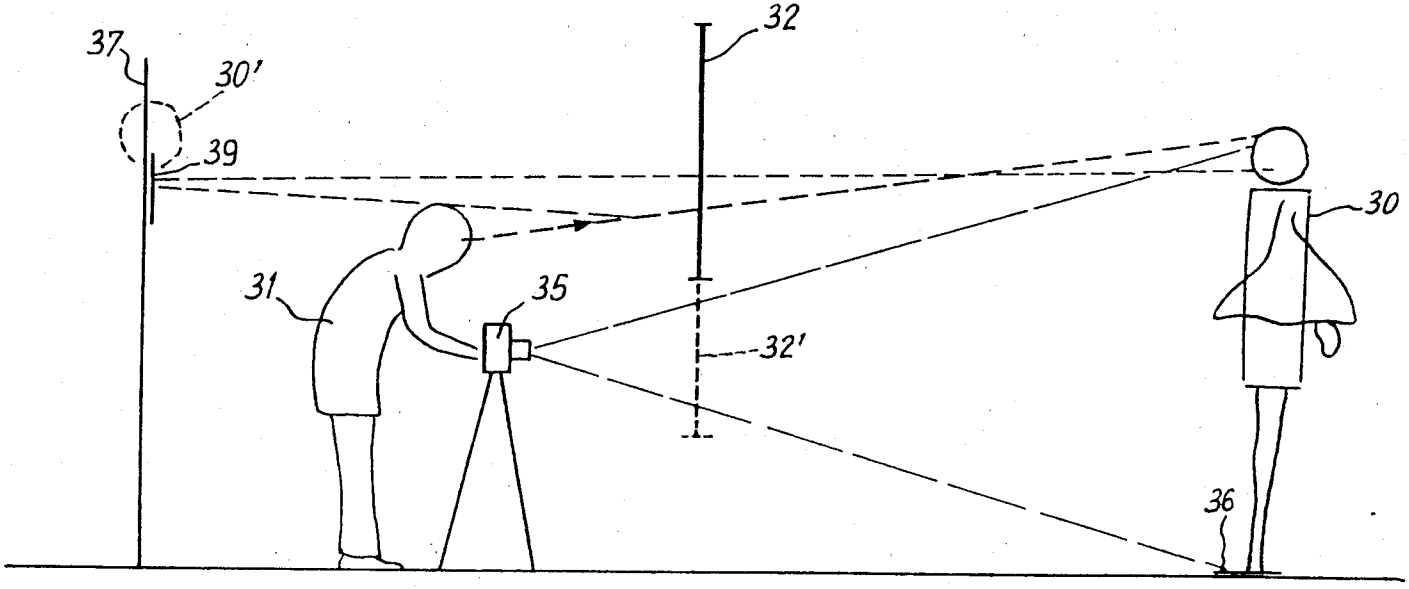
FIG. 7 is an elevational view of the scene shown in FIG. 6.

There will now be described, with reference FIGS. 6 and 7, the photographing procedure which achieves this calibration of the slides.

The photograph is taken of a model 30 who carries the adornment to be photographed and to whom will be given reference elements enabling him or her to assume the perfect position in the virtual gauge seen by the model but invisible on the photograph taken by the photographer 31.

The installation comprises a vertical unsilvered mirror 32 which slides vertically and is disposed between two uprights 33 whose verticality is checked by spirit levels 34 mounted on the feet of the uprights. The mirror 32 is located at sufficient height (about 1 meter so that the photograph can be taken by means of a camera 35 disposed below and behind it.

The model is invited to pose at a place identified by a mark 36 on the floor (usually on a carpet) and invisible in the photograph. At the rear of the mirror 32 and at the same distance there is disposed a panel 37 which is also placed on uprights 38 which are adjustable in height and on which panel a white or luminous sight mark 39 is carried illustrating the hollow of a neck or a shoulder.

It will be easily understood that the model sees, from the mark 36 and in the semi-transparent mirror 32:

on one hand, the sight mark 39, and on the other hand, his or her own image.

It is therefore possible to set the sight mark in height so that it is placed at the height of the hollow of the neck of the model. Thenceforth, the latter has a gauge with respect to which he or she can perfectly position himself or herself above the mark 36, if need be even in suitably posing if the successive models of adornment to be photographed are carried with shoes having more or less high heels. In other words, with the installation set in position, the model has merely to "position" his or her poses in such manner that the image of his or her neck in the mirror M2 tallies or marries up with the sight mark.

The photographer who stands behind his camera 35 with his head thereover sees through the mirror 32:

the model 30 and the (reflected) image of the sight mark 39.

In this way, the photographer can himself determine at which moment the neck of the model tallies well with the image of the sight mark 39 and therefore at which moment he can take the photograph.

As concerns the "centering" of the model (and of the adornment) in the slide photograph, the photographer has merely to move back his camera more or less until;

the lower horizontal edge of his field of the photograph is located just on the mark 36 (i.e. in front of the feet of the model)

and also the upper horizontal edge of this field passes for example across the tip of the nose of the model.

Indeed, henceforth:

the ground, i.e. the feet of the model and the nose and the shoulder height of the model, as well as those of all the other models which might be photographed, will be exactly positioned at the same places of the slides.

As seen before, these feet will therefore be positioned at the same place on the screen E, regardless of the models and regardless of the heights which will be given to the images 11 or 11' projected onto the screen E, depending on the variable extent to which the projector 1 is moved rearwardly on the rails 16, 17.

Likewise, for a given position of this projector on its funicular railway, the shoulder line of the images projected will always be the same regardless of the slides and regardless of the height of the model photographed. In this way, it is perfectly possible to calibrate the coupling of the motors respectively effecting the vertical displacements of projector 1 and of the projectors 10 so that there corresponds to any shoulder height of the images 11 and 11' the appropriate height of the projectors 10.

Moreover, it can be arranged that the photographer "checks" himself that his centering is quite correct by providing on each side of the sight mark 39 two lateral sight marks 40 and 41 the images of which he can see reflected in the mirror 32 when the latter is lowered to "position 32" between its uprights. If these sight marks may be shifted by means of rings on rods 42, it is possible by means of graduations on these rods to read the "height" of the model when the images of the lateral sight marks 40 and 41 are brought along the two vertical edges of the photographic field of the camera 35 when the latter is positioned as explained above. In this way, the photographer can make sure that his positioning is in conformity with the height indicated to him concerning the model to be photographed.

On the other hand, if a model indicates his height to the photographer, he can obtain his position (i.e. the rearward movement of the camera 35 with respect to the model) by means of these lateral sight marks.

As soon as, on all the slides, the hollow of the neck of the models who show the articles of clothing will be located at the same place, it becomes possible:

to embody on a "test" or "pilot" slide this hollow of the neck in the form of a sight mark, and to project this test slide so as to achieve, before any projection of an adornment, an adjustment "to size" (i.e. in height) of the projected corresponding image and adapt it to the height of the person who wishes to view himself or herself.

Indeed, it is sufficient to project this "test" slide onto the screen which then permits seeing behind the mirror the image of this sight mark marry up with the personal image of the person in front of the mirror.

Thenceforth, it merely remains to start up the motor 23 until the projector 1 is positioned on its funicular railway at such height that the sight mark (i.e. the hollow of the neck of the models) places itself in the hollow of the neck of the image of the person.

This operation may be carried by the person himself or herself by means of a simple control button.

Figure 8:
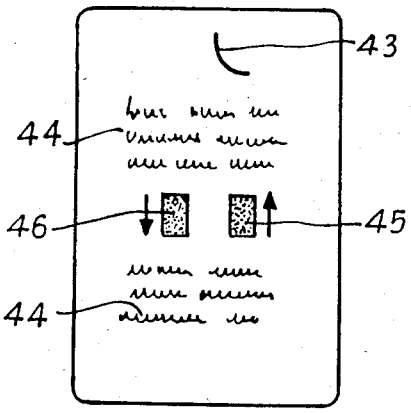
FIGS. 8 and 9 illustrate instructions slides with sight marks.

There has thus been shown in FIG. 8 the slide which enables this "setting to measure" to be carried out precisely and without an operator.

There can be seen on this slide:

on one hand, the "hollow of the neck" sight mark 43 which the person must bring to the height of his or her shoulders by expanding the projection in height of this slide, and, on the other hand, with the appropriate commentary 44, the illustration of the buttons which must be depressed by the person (on a head controlling the motor 33 placed at the end of a cable and held in the hand of this person) for the purpose of determining and controlling this expansion, namely:

a button 45 for raising the sight mark, a button 46 for lowering it.

Figure 9:
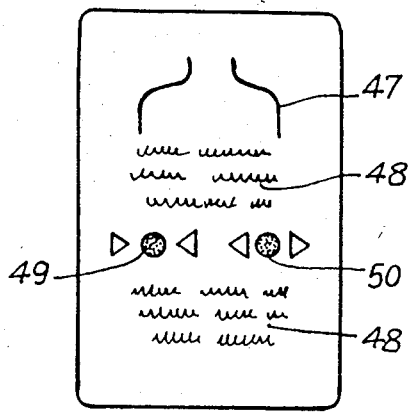

The same control operation can be carried out by means of a test or pilot slide shown in FIG. 9 so that the person who is viewing himself or herself "sets to measure" to his or her own corpulence, i.e. adjusts in width, the image projected onto the screen E from the slides photographed with normal models.

There is provided a breadth sight mark 47 and a person who sees this slide projected behind the mirror M merely has to actuate the motor driving the torsion bar of the mirror M2 according to the instructions 48, by depressing one of the buttons shown at 49 and 50 and located on the manual control head. The person sees the two shoulders of the breadth sight mark 47 move away from or toward each other and he merely has to bring this sight mark in coincidence with his or her own breadth.

When the person has thus effected the two adjustments:

in height, then in breadth by adjusting the sight marks 43 and 47 on his or her own image, the installation is set to the exact measure of this person. If the latter then depresses the "start" button of the control head which may be held in the hand, the "true" slides with the adornments start to be projected. The person then finds himself or herself in a fraction of a second clothed with clothing which is perfectly to measure. The "Cinderella" effect thus produced by the clothing which perfectly fits the body of a model exactly of the size of the person who is viewing himself or herself in a flattering pose and with no betrayal of a junction, which is consequently perfect, constitutes just what has been lacking in the installations of this type.

Now that the person who is viewing himself or herself identifies himself or herself perfectly with the image seen and as soon as he or she "feels" the clothing "on himself or herself", it is possible to use the installation in fields which were heretofore relatively closed to this treatment.

For example, as the head of the models is always placed in the same place on the slides, it is sufficient, upon projection, to provide a mask in front of the objective so as to hide the faces. The photographs can then be taken without requiring a hood or other masking means.

Further, it is possible to put on slides collections of historical clothes of museums and "clothe" the visitors of the museum.

Indeed, these clothes are extremely fragile and most often they have been made to suit persons whose heights and corpulences are very different from those of a person of the 20th century.

For example, historical figures were two or three centuries ago rather small and it is hardly possible to make their clothes "relive". On the other hand, an exceptional photograph, treated in accordance with the method illustrated in FIGS. 6 and 7, enables these clothes to be subjected to many "fittings".

Figure 10:
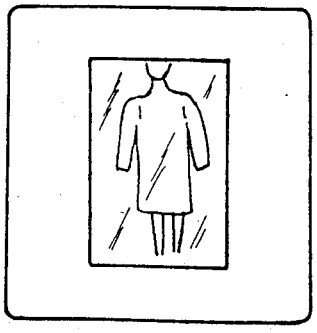
FIG. 10 is a view of a slide of the same type but concerning a photograph of a "wide" article of clothing.

Thus, a samurai dress (FIG. 10) carried by a model having the corpulence of the time may be photographed and projected in accordance with a special sight mark so that the projection may be brought to the size of a contemporary viewer.

Also, it may be envisaged to photograph, through the mirror M, personalized composite images (clients who wish to have views of several items of clothing so as to obtain an opinion in the family, for example children in fancy-dress, in fact with real royal clothes, etc).

Figure 11:
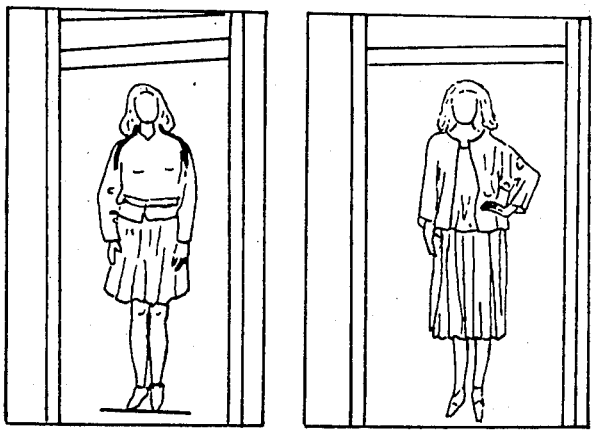
FIG. 11 is a view of two photographs side-by-side, one of which is a natural photograph while the other is a photograph of the corresponding composite image, i.e. with the superimposition of an article of clothing.

For example, there are shown in FIG. 11 a couple of photographs of this type which have been taken:

on the left, without a projection of an image, i.e. a photograph of the single personal image 51, on the right, a photograph of the same person (face 51) "dressed" by means of a projected image 52.

The effect of this type of photograph is moreover accentuated by the fact that the "merging" of the images is complete since the tridimensional image of the face is flat on the photograph in the same way as the projected image.

It is important to note that these photographs are especially original since the camera used for taking the photograph, which must be placed at 53 (FIG. 2) in front of the person in the room 6 and which would, in a normal conventional photograph in front of a mirror, appear on the photograph, does not appear on the latter.

Thus it will be understood that such photographs are only "credible" inasmuch as they correspond to the reality of a person who "feels" himself or herself to be in the article of clothing when the photograph is being taken. On the other hand, when this feeling is achieved, the photograph becomes "natural" and it becomes possible to develop its utilization.

These aspects should be stressed, since the invention makes possible a whole range of applications which were not possible in practice.

For example, it is clear that the recording of the respective viewing times of successive projections, controlled by the person himself or herself, the recording to the re-projections of the images for the purpose of seeing them again, and the recording of photographs which may be taken under the control of a slot machine, constitute extremely precious items of information as concerns the feeling out of opinion and the preparation of collections.

It must therefore be understood that the invention is not intended to be limited to the described and illustrated manners of carrying out the invention but is intended to encompass all modifications and developments thereof within the scope of the appended claims.

In particular, the methods for adjusting the sizes of the projected images and for taking the corresponding photographs have been described with reference to conventional equipment for projection onto conventional screens. It is obvious that the same methods could be applied to other types of projection, for example of the video or even of the holographic type.

Further, the adornments have been described as being clothes the images of which are to be made to tally with the image of the viewing person. The same methods may be applied to adornments of the jewelry or spectacle frame type whose images would be superimposed on the personal images of the persons viewing themselves.

We claim:

1. A method for projecting onto a screen of a projection installation images of a series of adornments of the body each superimposed on the screen with the personal image of a person, to form on the screen, for viewing by the person, a series of composite images of the person dressed with each of said adornments, the method being performed with the aid of a series of slides of said adornments and a preliminary slide illustrating a sight image but not an adornment, the slide of each said adornment having defined therein a dimension mark which is treated as a reference value corresponding to a body measurement which is easily identified on the personal image of any person, one of the elements of the dimension mark of the slide of each said adornment being treated as a reference base constituted by one end of the dimension mark, such that the dimension mark has a constant value for the slides of all said adornments and the images of the reference base of the slides of all said adornments will be projected at the same physical place on the screen, said method comprising the steps of:

placing the person in the installation at a location such that the image of the part of his or her body which corresponds to said reference base will be projected onto the screen at said physical place;

projecting the image of the person onto the screen with the person so placed and projecting the image of said preliminary slide onto the screen to form a composite image representing the person and said sight image;

adjusting the position of said sight image on the screen until said sight image tallies on the screen with the particular size of the person, thus to set the size of the images of said adornments to be projected onto the screen; and thereafter projecting the images of the series of slides of said adornments onto the screen, one after the other, while the person remains in said location;

the method being repeatable with a following person.

2. A method according to claim 1, wherein the adornments are clothes and their images are taken "down to the feet", i.e. on models standing up, the reference base is constituted by the ground and the value of the reference dimension is constituted by the height of the line of the shoulders from the ground.

3. A method according to claim 2, wherein the sight image is formed by an illustration of the hollow of the neck and a shoulder.

4. A method according to claim 3, wherein an additional reference base is constituted by the vertical axis of symmetry of the upright body and the value of the reference dimension therefor is constituted by the corpulence at the level of the belt.

5. A method according to claim 4, wherein said adjusting step is placed under the control of the person and the instructions for performing the adjusting step are given on said preliminary slide.

6. A method according to claim 5, wherein the control of the adjustment of the sight image is utilized to control at the same time the displacement of lighting directed towards the corresponding parts of the body of the person.

7. A method of preparing a slide of an adornment of the body with the aid of an optical system which is the reverse of that for obtaining a personal image of a person, said method comprising the following steps:

causing a model carrying said adornment to see himself or herself and at the same time a sight image and to adjust an image of said adornment relative to said sight image, and taking a photograph of the adornment and said sight image at the moment of coincidence of a predetermined portion of the adornment and said sight image.

8. An installation for carrying out the method according to claim 1, characterized in that the projection at a predetermined physical place on the screen of the reference base constituted by the ground in the images of the adornments is achieved by the following:

a slide projector for projecting images onto the screen, a ramp located in facing relation to said screen and having an inclination corresponding to the angle of opening downwardly of the beam of light projected by said projector, and a funicular system enabling said projector to be shifted along said ramp.

9. An installation according to claim 8, wherein the screen is transluscent and is disposed at 90° to the side of the installation and is seen by the person "to be dressed" in a mirror inclined at 45°.

10. An installation according to claim 9, wherein the projector is provided with a mirror at 45° which moves therewith along the ramp and is oriented to be parallel to the screen.

11. An installation according to 9, wherein the mirror inclined at 45° is curved by a vertical cylindrical deformation.

12. An installation according to claim 11, wherein the mirror inclined at 45° has a trapezoidal shape corresponding to the trace of the projected beam and means are provided for producing the vertical cylindrical deformation on the small base of the trapezium.

13. An installation according to claim 12, wherein spotlights for illuminating the face of the person "to be dressed" are provided on each side of the location reserved for said person, and means are provided for shifting the spotlights vertically in correlation with the movements of the projector on its ramp and for changing the intensity according to the skin color.

14. An installation according to claim 13, wherein the personal image is formed by the face of the person and a mask is provided in the beam of the projector for masking the face of the model showing an adornment on a slide.

15. An installation according to claim 13, wherein photographing means are provided in front of the location reserved for the person "to be dressed" and at a height located outside the part of the body of the person seen in his or her personal image, for the purpose of photographing the composite image formed by the personal image and the image of an adornment.

* * * * *